US011051669B2

(12) United States Patent
Goller

(10) Patent No.: US 11,051,669 B2
(45) Date of Patent: Jul. 6, 2021

(54) DUSTING AND DUST COLLECTING DEVICE

(71) Applicant: UDP GOLLER, Sandefjord (NO)

(72) Inventor: Hans Petter Goller, Sandefjord (NO)

( * ) Notice: Subject to any disclaimer, the term of this patent is extended or adjusted under 35 U.S.C. 154(b) by 453 days.

(21) Appl. No.: 15/778,468

(22) PCT Filed: Nov. 23, 2016

(86) PCT No.: PCT/EP2016/078576
§ 371 (c)(1),
(2) Date: May 23, 2018

(87) PCT Pub. No.: WO2017/089411
PCT Pub. Date: Jun. 1, 2017

(65) Prior Publication Data

US 2018/0353028 A1 Dec. 13, 2018

(30) Foreign Application Priority Data

Nov. 24, 2015 (NO) ..... 20151602

(51) Int. Cl.
*A47L 9/06* (2006.01)
*A47L 9/02* (2006.01)
*A47L 13/38* (2006.01)

(52) U.S. Cl.
CPC ..... *A47L 9/0606* (2013.01); *A47L 9/02* (2013.01); *A47L 9/0666* (2013.01); *A47L 9/0693* (2013.01); *A47L 13/38* (2013.01)

(58) Field of Classification Search
CPC ..... A47L 5/00; A47L 7/00; A47L 9/00; A47L 13/00
USPC ..... 15/246.2
See application file for complete search history.

(56) References Cited

U.S. PATENT DOCUMENTS 1,902,534 A 3/1933 Fred
5,692,263 A * 12/1997 Sorenson ..... A47L 9/02 15/393
6,370,731 B1 4/2002 Carter
2007/0277343 A1* 12/2007 Reiling ..... E01H 1/0836 15/344
2008/0155774 A1* 7/2008 Pang ..... A47L 9/242 15/144.1
2010/0170060 A1* 7/2010 Eccardt ..... A47L 5/36 15/415.1
2010/0249755 A1* 9/2010 Zappala ..... A61M 1/0049 604/540
2013/0255022 A1* 10/2013 Hammon ..... A47L 9/0693 15/246.2

(Continued)

*Primary Examiner* — David Redding
(74) *Attorney, Agent, or Firm* — David Guerra

(57) ABSTRACT

A dusting and dust collecting device including a hollow body featuring a hollow section and an outer shell, and a brush. The hollow body includes an open end being open to a hollow section of the hollow body, and adapted to be connected to an external vacuum source by a fastener. The hollow body includes a plurality of grooves arranged along an outer circumference of the hollow body creating a plurality of canals. At least one perforation extends from the hollow section of the hollow body and through an outer shell and connects with at least one of the plurality of grooves for distributing a vacuum in the plurality of canals when the brush is covering the plurality of grooves, and the hollow body is connected to the external vacuum source.

20 Claims, 7 Drawing Sheets

(56) References Cited

U.S. PATENT DOCUMENTS

2015/0297045 A1* 10/2015 Marsh ..... A47L 5/24
15/328
2016/0129167 A1* 5/2016 Alai ..... A61M 1/0086
604/319

* cited by examiner

DUSTING AND DUST COLLECTING DEVICE

CROSS-REFERENCE TO RELATED APPLICATIONS

This application is an U.S. national phase application under 35 U.S.C. § 371 based upon co-pending International Application No. PCT/EP2016/078576 filed on Nov. 23, 2016. Additionally, this U.S. national phase application claims the benefit of priority of co-pending International Application No. PCT/EP2016/078576 filed on Nov. 23, 2016 and Norway Application No. 20151602 filed on Nov. 24, 2015. The entire disclosures of the prior applications are incorporated herein by reference. The international application was published on Jun. 1, 2017 under Publication No. WO 2017/089411 A1.

BACKGROUND

Technical Field

The present invention regards a dusting and dust collecting device. The device comprises a hollow body with at least one open end, the open end being adapted to be connected to an external vacuum source by fastening means. The hollow body comprises a plurality of grooves arranged on an outer circumference, creating a plurality of canals, and wherein at least one perforation extends through the outer shell of the hollow body and connects with at least one of the plurality of grooves. A dust brushing means in form of a brush or a duster is adapted to be fitted over at least part of the plurality of grooves, for distributing a vacuum in the plurality of canals. The device is arranged for attracting and collecting dust and particulates.

Background of the Invention

There are several known methods to remove dust and particulates from all surfaces, such as furniture's, walls, ceilings, bookcases, loose objects, etc. The most common sweeping and dust removal devices are the traditional dust brushes with different appearances. These brushes comprise a handle for gripping and a body/arm extending from the handle. Attached to the body/arms are different dusts brushing means. Traditionally, these dust brushing means or attachments comprise different animal or synthetic hair fibers or feathers.

Nowadays, different fabrics and cloth are suitable for dusting at removal of dust; the have electrostatic properties with dust, debris and particles accumulating ability. Most common are the microfiber fabrics. Microfiber used for commercial cleaning products also includes many products constructed of 100% polyester microfiber. Fabrics made with microfibers are exceptionally soft and hold their shape well. Microfiber textiles designed for cleaning clean on a microscopic scale. According to tests using microfiber materials to clean a surface leads to reducing the number of bacteria by 99%, whereas a conventional cleaning material reduces this number only by 33%. Microfiber cleaning tools also absorb fat and grease and their electrostatic properties give them a high dust-attracting power.

A modern version of a dust brush is the Swiffer® Duster with interchangeable brush. The Swiffer® Duster comprises a handle and a flexible body to hold a replaceable/refill brush. The brush uses thousands of fluffy fibers of microfiber to trap and lock dust from virtually any surface. A disadvantage of such manual brushes like the Swiffer® Duster is that, although they are able to trap and lock dust more effective than the traditional feathers, there is still a challenge to remove a bigger amount of the dust, and avoid the dust particles to be whirled up in the air. Further, the dust and particulates that are trapped inside the brush has to be cleaned regularly or to be replaced by a new. Hence, there exist a need for a dust trapping and collecting device, which can attract dust more efficiently, last longer in use and remove the collected dust and particulates continuously.

A vacuum cleaner is a device that uses an air pump to create a partial vacuum to suck up dust and dirt. The dirt is collected by either a dust-bag or a cyclone for later disposal. Vacuum cleaners, which are used in homes as well as industry, exists in a variety of sizes and models, small battery-powered hand held devices, wheeled canister models for home use, domestic central vacuum cleaners, huge stationary industrial appliances that can handle several hundred liters of dust before being emptied. Most vacuum cleaners are supplied with numerous specialized attachments, such as tools, brushes and extension wands, which allow them to reach otherwise inaccessible places or to be used for cleaning a variety of surfaces. The most common of these tools are:

Hard floor brush
Powered floor nozzle
Dusting brush
Crevice tool
Upholstery nozzle Numerous attempts have been made to incorporate vacuum or suction-type features into various cleaning tools and devices.

Publication WO 2008048552 A2, discloses a cleaning and dusting device having a small handle that houses a vacuum assembly having an electric motor and a battery. The device further includes a duster assembly for removeably holding a dusting cloth or duster assembly. The vacuum source can be fluidly connected to and draw a vacuum airflow through the duster assembly.

Publication US 20060179607 A1, discloses a duster brush assembly for a vacuum cleaner. The duster brush assembly includes a duster brush fixedly disposed at the airflow entrance of a hollow tubular member operatively connected to the vacuum cleaner. The duster brush can be cleaned without having to be removed from the vacuum cleaner.

Publication U.S. Pat. No. 5,692,263 A, discloses a vacuum tool for delicate dusting of plants and similar fabrics. The tool has an inner and an outer shell. The inner shell has a distribution of holes providing even volume of airflow. The outer holes are sunk within grooves so that fabrics, leaves, petals, and the like are not sucked against the holes. The grooves also provide even suction over the surface of the outer shell.

Publication US 2009/0044372 A1, discloses a handheld portable device for dislodging and capturing particulate matter that has been accumulated on various surfaces or structures. The devices comprises a nose segment extending away from a handle, wherein a vacuum airflow is entering the nose segment and a high pressure airflow is exiting the nose segment. The high pressure airflow dislodges at least some of the particulate matter from the surface to be cleaned for capture by the vacuum airflow and correspondingly allows non-contact particulate matter removal from the surface to be cleaned.

Publication DE 3831953 A1, discloses a vacuum cleaner attachment consisting of a tubular connecting piece with opening(s) at its suction end and having long whirling-up elements that are attached at one end to the connecting piece.

The free ends being soft and flexible on contact with the surfaces and objects from which the dust is to be removed, and the whirling-up elements as a whole have a flexural rigidity which substantially withstands the suction airflow produced.

Each of the prior art publications shows different advantageous features for attracting, collecting and removing dusts. Thus, there is a need for a dust brushing and collecting device, which can attract, collect, remove and store the dust and particulates in a more effective way. The aim of the present invention is to collect and remove a bigger amount of the dust using a device, which is simple, efficient, economical in use and easy to mass produce.

SUMMARY OF THE INVENTION

In the following, the term vacuum is referred to a space in which the pressure is lower than atmospheric pressure. A vacuum is referred to an under-pressure state or a suction pressure state.

The term vacuum source is in the following referred to a device creating a partial vacuum, hence any device that can create suction or a pressure lower than the atmospheric pressure. A common vacuum source is a vacuum cleaner, but it also includes other apparatus and devices creating a suction power driven both electrically or manually.

In the following the term dust is referred to all dust and particulates (on surfaces and in the air) in homes, offices, and other human environments containing small amounts of plant pollen, human and animal hairs, textile fibers, paper fibers, minerals from outdoor soil, human skin cells, burnt meteorite particles, and many other materials which may be found in the local environment.

It is an object of the present invention to increase the total dust collection or dust removal effect during dusting.

Another object of the present invention is to reduce the time spent by dusting.

Another object of the present invention is to provide a device, which is easily to apply and use.

Yet, another object of the present invention is to provide a device that can easily be mass-produced for commercialization.

Yet, another object of the present invention is to provide a device that can easily be converted and used for various applications.

It is yet another object of the present invention to provide a specialized attachment to a vacuum cleaner, which allows the user to remove dust and particulates from all surfaces in an easier and more effective way.

The present invention relates to a dusting- and dust collecting device. The device comprising;

a hollow body comprising a hollow section and an outer shell, and [0029] a dust brushing means.

The hollow body comprises an open end, which open end being open to the hollow section of the hollow body and adapted to be connected to an external vacuum source by fastening means.

The hollow body further comprises a plurality of grooves arranged on an outer circumference of the hollow body creating a plurality of canals. At least one perforation extends from the hollow section of the hollow body and through the outer shell and connects with at least one of the plurality of grooves for distributing a vacuum in the plurality of canals, when the dust brushing means is covering at least a part of the plurality of grooves, and the hollow body is connected to the external vacuum source.

The at least one perforation can have different locations. Also at least one perforation can be associated with at least one canal.

Preferably, the at least one perforation extends from the hollow section of the hollow body and through the outer shell and connects with a least a plurality of grooves for distributing a vacuum in the plurality of canals.

According to a preferred embodiment of the present invention, each of the plurality of grooves has an annular shape, and the plurality of grooves is arranged in parallel to each other and over at least a length of the hollow body.

Within the scope of the invention, the plurality of grooves arranged on the outer circumference of the hollow body can be interconnected such that they display at least one continuous canal. In another embodiment, the plurality of grooves can be interconnected displaying a helical canal along the periphery of the hollow body and over at least a part of a length of the hollow body.

A hollow body is referred to a body having an outer shell with an inside shell-surface and outside shell-surface. The body allows air and dust to pass through the hollow section. The hollow body can have different appropriate shapes according to the application. The hollow body can have at least one of following shapes, such as elongate, circular, T-shape, S-shape, Y-shape, square, oval, conical, etc. The invention also includes the combination of different shapes.

It is also within the scope of the invention that the inside shell-surface of the hollow body can have different textures or shapes. In a preferred embodiment the inside shell-surface comprises a plurality of grooves corresponding to the outside shell-surface of the hollow body, creating a plurality of canals on the inside shell-surface of the hollow body as well on the outside shell surface. Preferably the plurality of grooves at the outside shell-surface and the inside shell-surface corresponds such that the bottom of a canal of the outer shell-surface displays the top of a canal at the inside shell surface. This advantageous feature also allows the hollow body to be more flexible.

According to the present invention, the hollow body can be made from different material. In a preferred embodiment, the body can be made from a flexible material, such as plastic, rubber, composite, or a combination of different materials. Other material can also be used, including non-flexible material. Appropriate manufacturing methods comprise extruding, molding, injection molding, compression molding and even machine cut. It is also within the scope of the invention that this includes all materials appropriate for these manufacturing methods.

According to the present invention, the hollow body of the dust collecting device can also be plastically formable. Plastically formable means that it will stay in a predefined shape, thus allowing the hollow body to be formable depending on the different uses. In this case, the hollow body is made from plastically formable materials. Example of such materials can be plastic, rubber, composite, metal, alloy and different combinations of the said materials. Preferably, the plastically formable material can be arranged over at least a part of a length of the hollow body.

According to the present invention, the dust brushing means comprises an interchangeable threads stocking-like cover made from air-open fabric or breathable fabric. The term air-open fabric, is referred to a perforated fabric or breathable fabric or material allowing a certain amount of air to pass through the fabric or material. The stocking-like cover is adapted to be fitted over at least a part of the hollow body. The stocking-like cover is referred to a cover, displaying an open end to be fitted over the shape of the body.

Advantageously, the stocking-like cover has a similar shape as the hollow body for a snug fit. Further, the cover can be made from different fabrics and materials, advantageously with a flexible fabric, creating a tight and snug fit covering the hollow body.

Further, the stocking-like cover fabric can have a smooth surface for dusting and collecting of dust. In some contexts, the dust brushing means can be a pipe, a tube or a sieve that the hollow body can be inserted into. It is also within the scope of the invention that the dust brushing means can be made from different materials. Advantageously, the dust brushing means are made from dust attracting fabrics having electrostatic properties with dust, debris and particles accumulating ability, like the Microfiber fabric.

A further advantage of the cover is that it comprises a plurality of dust attracting and dust collecting threads or ribbons having electrostatic properties with a high-dust-attracting power, in that the fabric accumulates dust, debris and particles. The plurality of fluffy fibers can trap and lock dust and hair from almost all surfaces. Advantageously, the dust brushing means is a replaceable device. Within the scope of the invention, another type of cover can comprise any kind of fabric or material capable of removing dust from the surface, so that the dust can be sucked or collected into the dust collecting device.

In a preferred embodiment of the present invention, the body has a shape of an elongated body with two ends, an open end and a free end. The open end being adapted to be connected to an external vacuum source, while the free end comprises at least one though hole (opening) for collecting dust. The free end is in connection with the hollow section of the hollow body. When collecting dust from the free end of the hollow body, the dust and particulates is transported into the through hole and further through the hollow section of the hollow body, and extracted at the open end into a vacuum source.

The free end can have a flat front or a slant shape form, or other appropriate shapes. In a preferred embodiment of the invention, the free end comprises a slant shape front with two through holes for collecting dust through the hollow body. This free end shape is designed to capture dirt and dust in the front of the hollow body, simultaneously providing a "pick-up" function. The shape also provides agility in tight areas and corners typically lists corners and crannies and prevents the wear of the dust brushing means.

Yet, in a preferred embodiment of the present invention, the body has a shape of an elongated body with a plurality of grooves arranged perpendicular to the longitudinal direction of the body. Each of the plurality of grooves having an annular shape, and wherein the plurality of grooves is arranged in parallel to each other and over the whole length of the hollow body.

Corresponding grooves can also be arranged on the inside shell-surface of the hollow elongated body, making the elongated body more flexible. The plurality if grooves forming a plurality of canals at both sides of the outer shell surface of the hollow body.

Further, at least one perforation extends from the hollow section of the hollow body and through the outer shell. The at least one perforation is located in connection with the plurality of grooves at the outside shell-surface and the inside shell-surface, creating an interconnecting canal system. Advantageously, each individual annular canal on the hollow body is associated with one perforation hole. The one perforation hole is associated with several canals.

When pulling a dust brushing means outside the plurality of grooves, the interconnecting canal system will be partially closed, creating an equal pressure in the canals associated with the at least one perforation, when a vacuum source is connected to the hollow body. This feature distributes the vacuum-sphere of the elongated body, and the ability to control the airborne dust and particulates surrounding the elongated body. Again, the grooves also make the elongated body more supple and flexible, increasing the stealthy effect and access to narrow and hard to reach places. As described earlier, the elongate body can also be plastically formable such that it can adapt to the different uses.

The elongated body can have different appropriate length and comprise different number of perforation holes. The holes can be located on both side of the longitudinal body and may preferably be displayed with a longitudinally offset so that they are covering a different section of grooves/canals.

The cross-sectional shape of the body can be circular, square, oval, or other appropriate shapes, such as T-shape, square or combination thereof.

Advantageously, the cross-sectional shape of the elongated body is circular or oval.

In a preferred embodiment of the present invention, the at least one open end of the body is connected to a vacuum cleaner through an adapter-head. Advantageously the vacuum source is a vacuum cleaner or similar vacuum source creating same effect.

The present invention relates to a dusting and dust collecting device comprising a hollow body with at least one open end. The open end being adapted to be connected to an external vacuum source by fastening means. The at least one open end of the body can be either connected directly to the vacuum source, or indirectly through an adapter-head. The fastening means comprises a locking system known from prior art for the assembling and fastening of two components. Such locking system may for example be screw fastening, buckle snaps, snap-locks, overlapping sections, pin-lock, friction lock, etc. or a combination thereof.

In a preferred embodiment of the present invention, the fastening means comprises a snap-lock/pin lock system. In a more preferred embodiment, the fastening means comprises two overlapping sections, fixed together by friction. This can be illustrated by the open end of the hollow body being adapted to closely fit into the second end of the adapter head. Preferably, the open end of the hollow body and the second end of the adapter head has similar cross sectional shape, for a thigh and rigid pairing. The two sections can be dismounted by pulling them apart.

In another preferred embodiment, the fastening means comprises a key-lock arranged in the extension of the open end of the hollow body. The extended key-lock section comprises a locking device, which engages with a recess on the adapter-head. By inserting the extended key-lock section into the adapter-head, the body can be attached to the adapter-head by a click-lock function. A eject button device is arranged on the adaptor-head for the release of the hollow body from the adaptor-head.

It is also within the scope of the invention that other conventional locking and releasing systems can be used.

According to the invention, both the dust brushing means and the hollow body are replaceable as a refill device, together or separately.

The adapter-head comprises a handle grip together with a first and a second end. The first end being adapted to be releasable connected to the external vacuum source and the second end being adapted to be releasable connected to the open end of the hollow body. Further, the second end comprises a flexible chock joint to improve the accessibility of the hollow body when attached to the adaptor-head, allowing the body to flex in different directions. The flexible chock joint acts as a flexible coupling section of the hollow body, providing a better user experience, and increases the creep function and being secured with a key-lock locking the body to the adaptor-head.

Further, the adapter-head comprises a converter arranged at the first end of the adaptor-head. The term converter is referred to a size regulator device configured to allow external vacuum source intakes of various sizes to establish a tight fit with the converter. The converter adapts the first end of the adapter-head to the different dimensions of the external vacuum source.

This arrangement extends the use of the dusting and dust collecting device; making is more adaptable to the different vacuum source available. Advantageously, the converter is adapted to the most widely used intake openings of vacuum cleaners today, preferably with a cross section diameter size of 32 mm and 35 mm. It can easily be produced converters adapted to other format and vacuum sources.

In a preferred embodiment of the present invention, the adapter-head comprises a main suction hole positioned adjacent to the second end, preferably, the suction hole is positioned below the second end opening. The main suction hole is designed for the collection of dust from the dusters vacuum sphere and the dust brushing means.

Further, it is designed so that it can easily capture larger particles, which are not affected by the dust brushing means, similarly as a pick-up function.

Further, the adapter-head comprises a valve for adjusting the suction pressure in the hollow body. In a preferred embodiment of the present invention, the adaptor-head comprises two valves arranged at the front part and at each side of the adaptor-head. These valves create a side vacuum controllable by a thumb or a finger, in form of a Finger-Lock device, and can be use both by right or left-handed person. These valves have an intake for dust collecting purpose, but also for compensating for the increased pressure-resistance in the hollow body. The valves allow the user to easily adjust the vacuum inside the hollow body by a thumb. The valves can easily be closed by pressing a finger on the valve for controlling the pressure in the hollow body and in the main suction hole. This function moves/increases the vacuum forward in the hollow body construction.

Also within the scope of the invention, the adaptor head can also be an integrated part of the hollow body, creating one single unit. This means that all features or at least one feature of the adaptor-head can be an integrated part of the hollow body. The single unit is being adapted to be connected to an external vacuum source by fastening means.

BRIEF DESCRIPTION OF THE DRAWINGS

Various objects, features, aspects and advantages of the inventive subject matter will become more apparent from the following detailed description of preferred embodiments, along with the accompanying drawings figures in which like numerals represent like components.

DETAILED DESCRIPTION OF DRAWINGS

Figure 1:
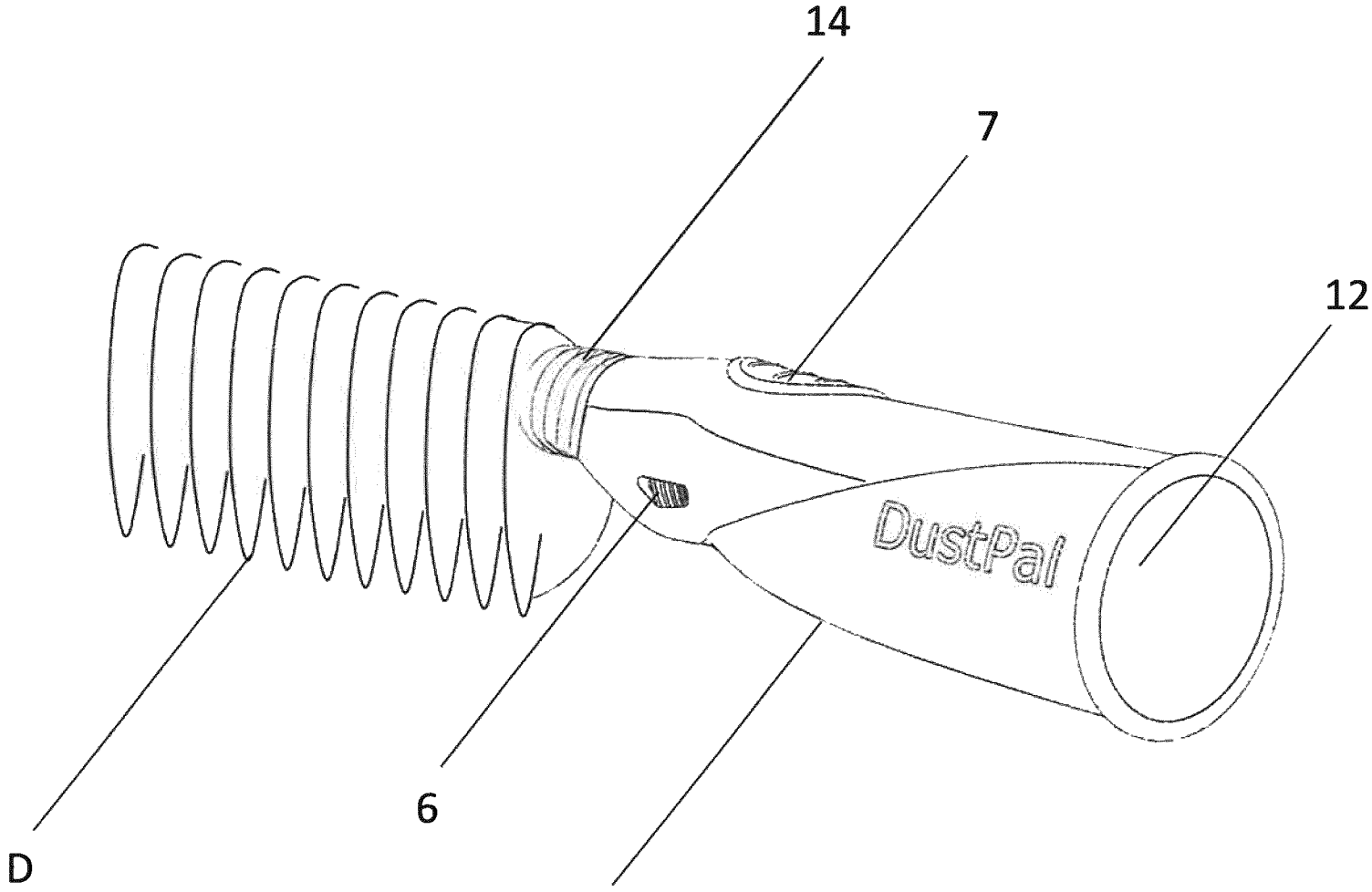
FIG. 1 shows an embodiment of the present invention where the dust brushing means is fitted over the hollow body, and the hollow body is inserted into the adaptor-head.

FIG. 1 shows an embodiment of a dusting and dust collecting device, according to the present invention. The device comprises an elongated body A (not shown) covered by a dust brushing means D in form of a brush D made from a plurality of fluffy fibers, threads or ribbons. The fluffy fibers, threads or ribbons having electrostatic properties with a high-dust-attracting power, in that the fabric accumulates dust, debris and particles. The dust brushing means D is a refill and replaceable device, which can be replaced after use. The FIG. 1 shows a preferred embodiment of the device according to the present invention, the device is ready for connection to a vacuum source indirectly through an adaptor-head B. The adaptor-head B comprises a form-shaped handle grip, a first end 12, and a second 13 (not shown) end.

Figure 2:
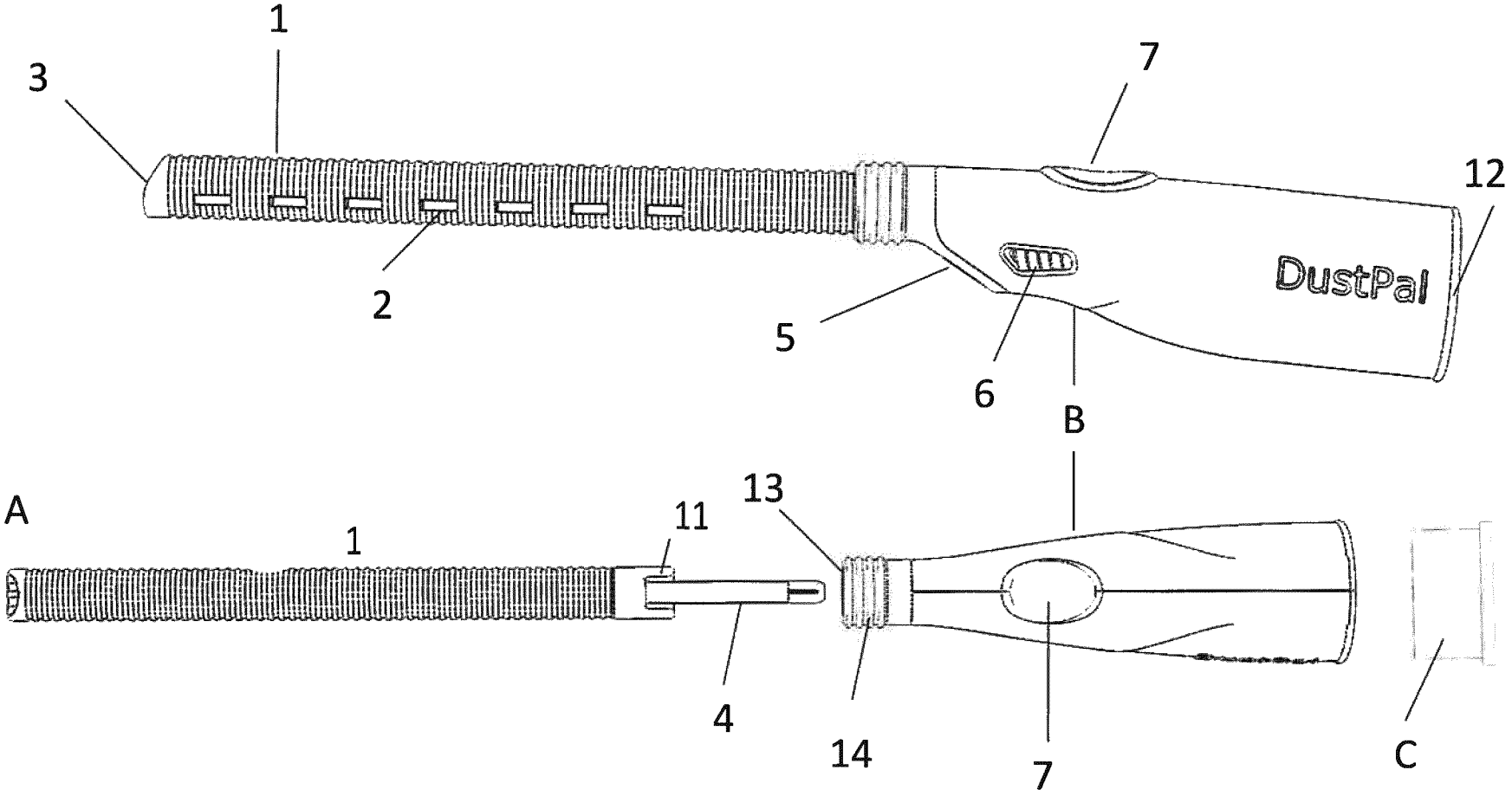
FIG. 2 shows a top- and side-view of the subject matter according to the invention.

FIG. 2 shows an embodiment of a dusting and dust collecting device according to the present invention. The device comprises a hollow body A in form of an elongated tube A. The elongated tube A comprises one open end 11 and one free end 3.

The open end 11 comprises a fastening means 4 in form of an extended key lock section 4 for quick and easy locking of the tube 4 to an adaptor-head B. According to the invention, other fastening means can also be used, such as friction lock, snap lock, spigot joint, screw lock, and other similar quick locking mechanism. The adapter-head B comprises a handle grip together with a first end 12 and a second end 13. The first end 12 being adapted to be releasable connected to the external vacuum source and the second end 13 being adapted to be releasable connected to the open end 11 of the elongated tube A. An eject button 7 is located on the upper part of the adaptor-head B for the quick and easy release of the elongated tube A. The elongated tube A can be connected directly or indirectly by means of an adaptor-head B to a vacuum source, such as a vacuum cleaner. The elongated body A further comprises a plurality of grooves 1 arranged in parallel to each other and perpendicular in the longitudinal direction of the elongate tube A. Corresponding grooves (not shown) can also be arranged on the inside shell-surface of the hollow elongated tube A, making the elongated tube A more bendable and flexible. Each groove 1 is again connected to a perforation hole 2 with opening extending into the hollow tube A. When pulling a dust brushing means D outside the grooves 1, and covering the elongated tube A, a series of canals are created on the surface of the tube A. When the elongated hollow tube A is connected to a vacuum source, such as a vacuum cleaner, an under pressure (suction) or vacuum is created in the canals associated with the at least one perforation hole on the body A. This arrangement distributes the vacuum-sphere and the ability to control the airborne dust surrounding the elongated tube A. The grooves 1 also make the elongated tube more supple and flexible, increasing the stealthy effect and access to narrow and hard to reach places. As shown in FIG. 2 the perforations 2 has form as square shaped holes located on the elongated tube A. The number of perforations can vary according to the different shapes and lengths of the hollow body A. FIG. 2 shows 7 holes at one side of the elongated tube A. The holes 2 on the other side of the tube may preferably be displayed with a longitudinally offset so that they are covering a different section of grooves (not shown).

FIG. 2 also shows the free end 3 of the elongated tube A, having a sloping shape with two suction holes. These suction holes can be seen more clearly in FIG. 3. Also seen from FIG. 2 are the main suction hole 5 located below the first end of the adaptor-head B. Further, a valve 6 is located at each side of the adaptor-head B. The valve 6 comprises a plurality of flaps arranged at the opening. The valve 6 is readily available and controlled by a thumb or any other finger of the user. Same arrangement of the valve 6 at the opposite end of the adaptor-head B, allows the device to be used both by right or left handed. At the first end 12 of the adaptor-head, B a converter C is arranged for the easy adaption of the adaptor-head B to intake of the different vacuum source (not shown).

Figure 3:
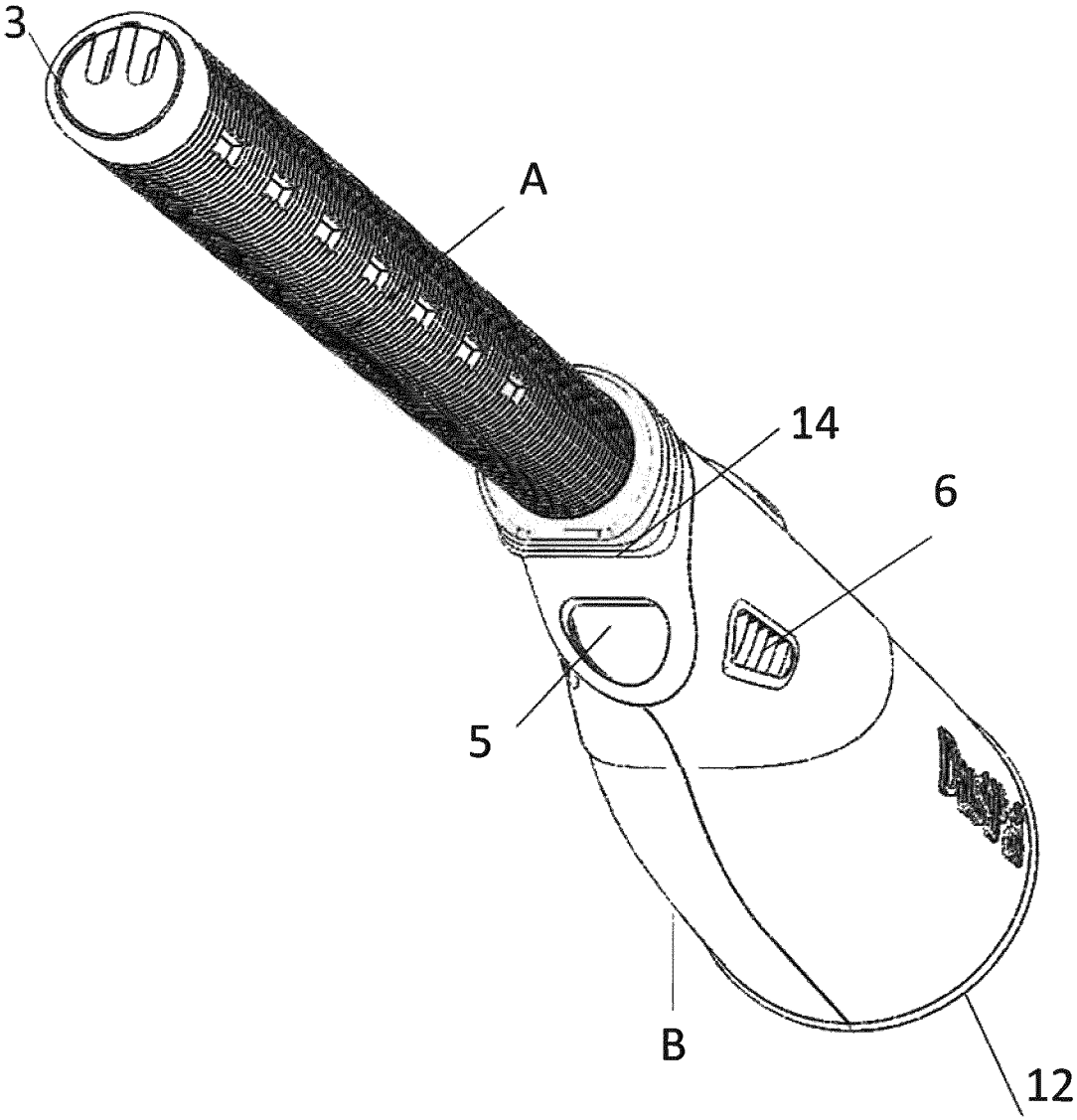
FIG. 3 shows a front view from below, of the dusting and dust collecting device without the dust brushing means attached.

FIG. 3 shows the dusting and dust collecting device according to the present invention seen from below. The free end 3 of the elongated tube A comprises two suction holes. Also shown are the pluralities of grooves/canals 2 together with the associated perforation holes 2. The elongated tube A is adapted to be inserted into the adaptor-head B. At the connection point between the hollow body and the adapter-head, a flexible chock joint 14 is arranged. The flexible chock-joint 14 are preferably made from an elastic material for easy and thigh locking of the elongate tube A. Preferably, the locking of the elongate tube A is made by friction between the flexible chock joint 14 and the surface of the elongate tube A. The main suction hole 5 is arranged below the connection point and at least one valve 6 is located at one side of the adaptor-head B.

Figure 4:
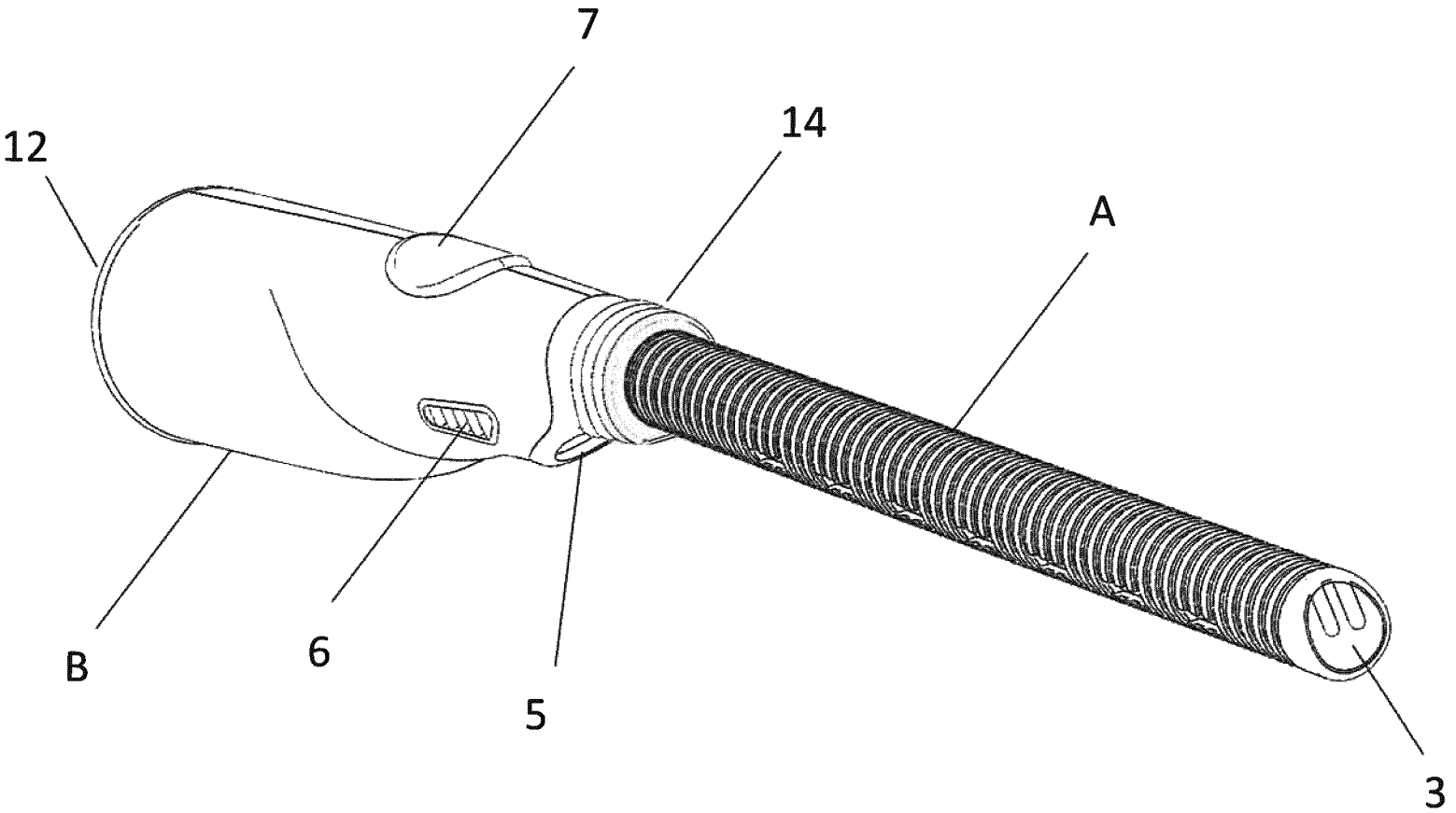
FIG. 4 shows a side view from above, of the dusting and dust collecting device without the dust brushing means attached.

FIG. 4 shows the dusting and dust collecting device according to the present invention seen from above. The eject button 7 located at the top part of the adaptor-head B.

Figure 5:
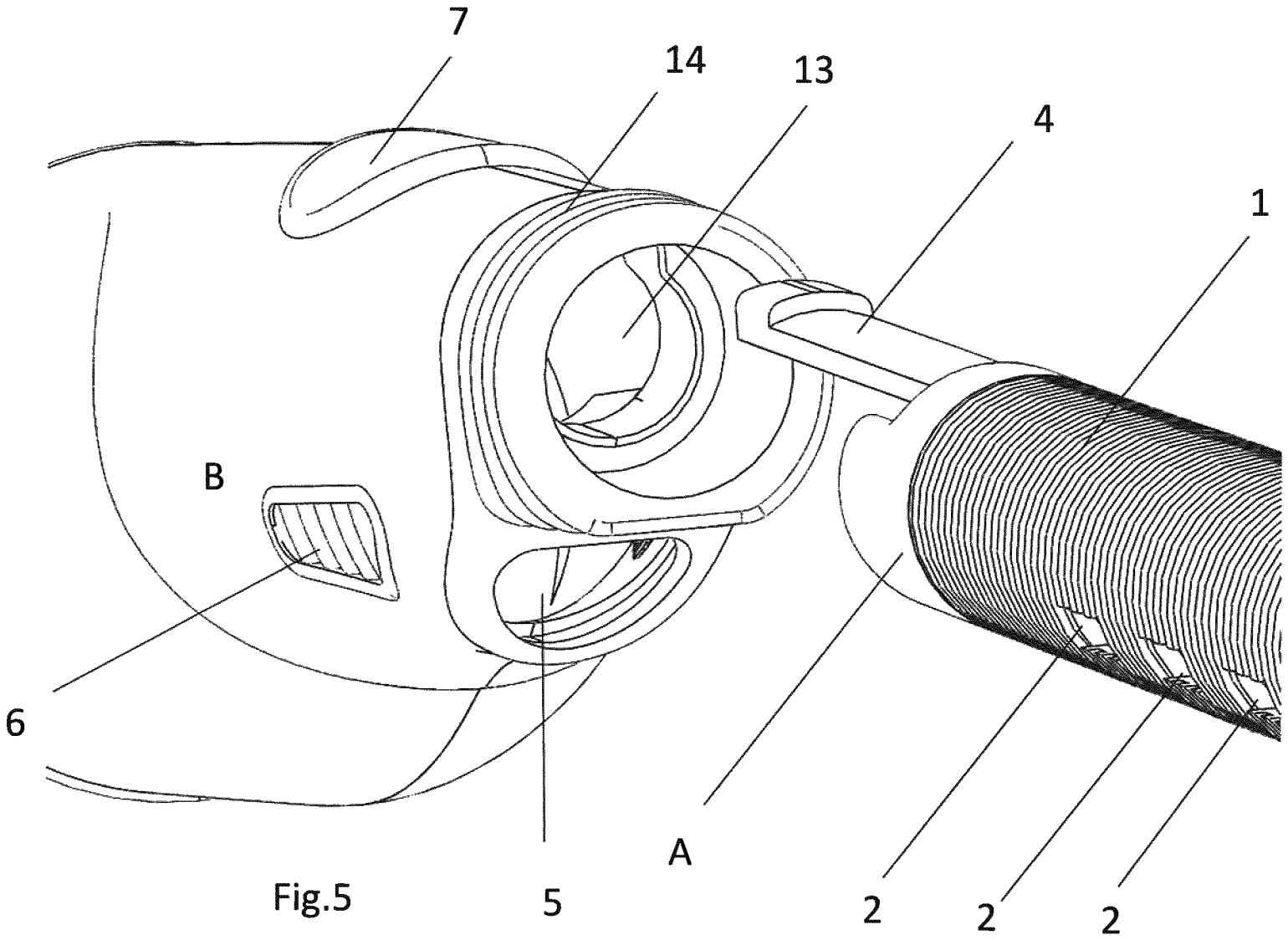
FIG. 5 shows the second end of the adaptor head together with the flexible shock joint and the extended key-lock section of the hollow body.

FIG. 5 shows the adapter-head B with a handle grip together with a first (not shown) and a second end 13. The first end 12 being adapted to be releasable connected to the external vacuum source and the second end 13 being adapted to be releasable connected to the open end 11 of the hollow longitudinal tube A. Further, the second end 13 comprises a flexible chock-joint 14 to improve the accessibility of the hollow longitudinal tube A when attached to the adaptor-head B, allowing the tube A to flex in different directions. The flexible chock joint 14 acts as a flexible coupling section of the hollow body A, providing a better user experience, and increases the creep function and being secured with a key-lock/pin-lock, locking the body to the adaptor-head B. In the preferred embodiment of the present invention, the key-lock 4 comprises an elongated locking pin 4, which engages a recess in the adaptor-head B, such as a click on snap-lock locking device.

Figure 6:
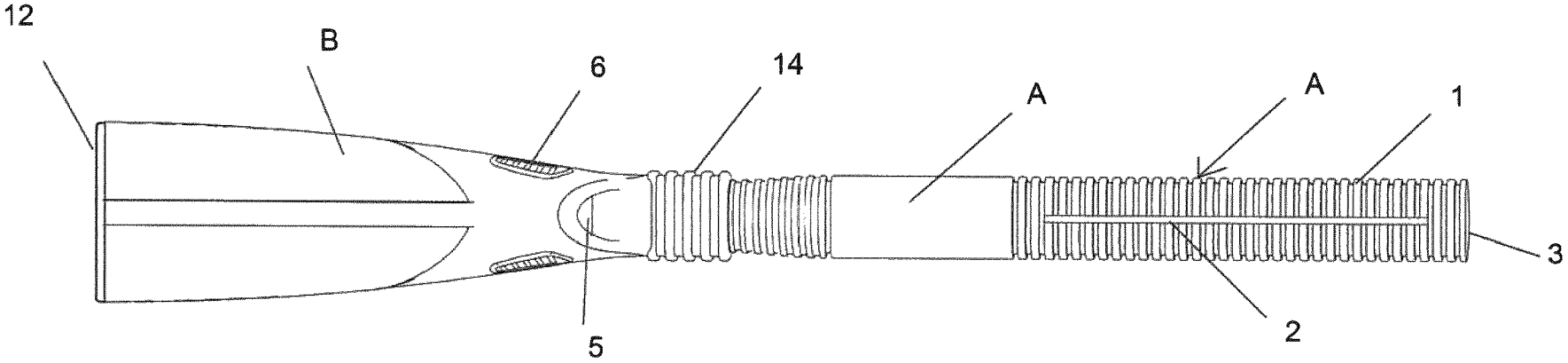
FIG. 6 shows another embodiment of the present invention where the hollow body comprises a plurality of grooves in connection with one perforation.

FIG. 6 shows another embodiment of the present invention where the hollow body A has an elongate tube shape and comprises a plurality of grooves 1 in connection with one perforation 2. The perforation 2 has also an elongate shape and situated at the underside of the hollow body A, viewed in a user position. According to the invention, the one perforation can have different shape and situated at different areas on the hollow body A.

Within the scope of the invention, each of the plurality of grooves 1 has an annular shape and arranged in parallel to each other, and over at least a part of a length of the elongate hollow body A. The FIG. 6 shows an embodiment of the present invention where a plurality of annular grooves 1 is on the outer circumference of the hollow body A, and the plurality of grooves 1 is arranged over a part of the length of the elongate hollow body A. According to a preferred embodiment of the present invention, the plurality of grooves 1 is situated perpendicular and arranged over the entire length of the elongate hollow body A.

Figure 7:
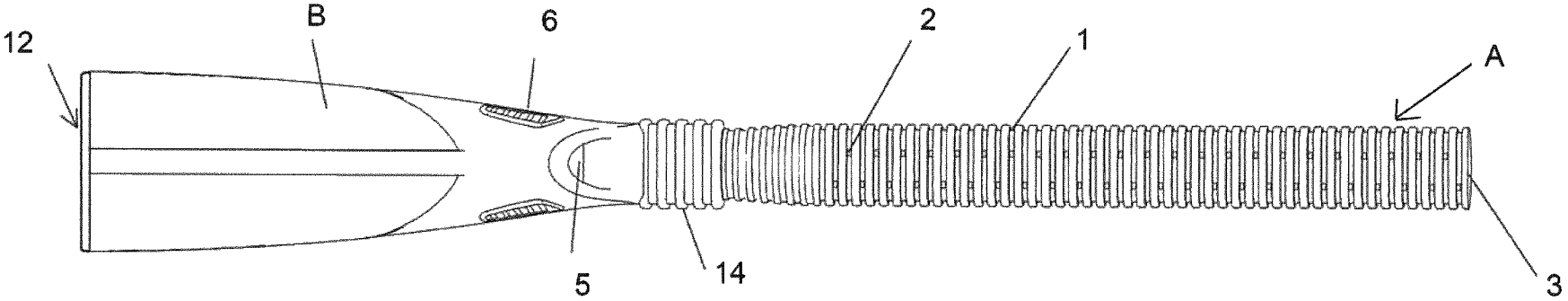
FIG. 7 shows yet another embodiment of the present invention, where one perforation is associated with one canal.
Figure 8:
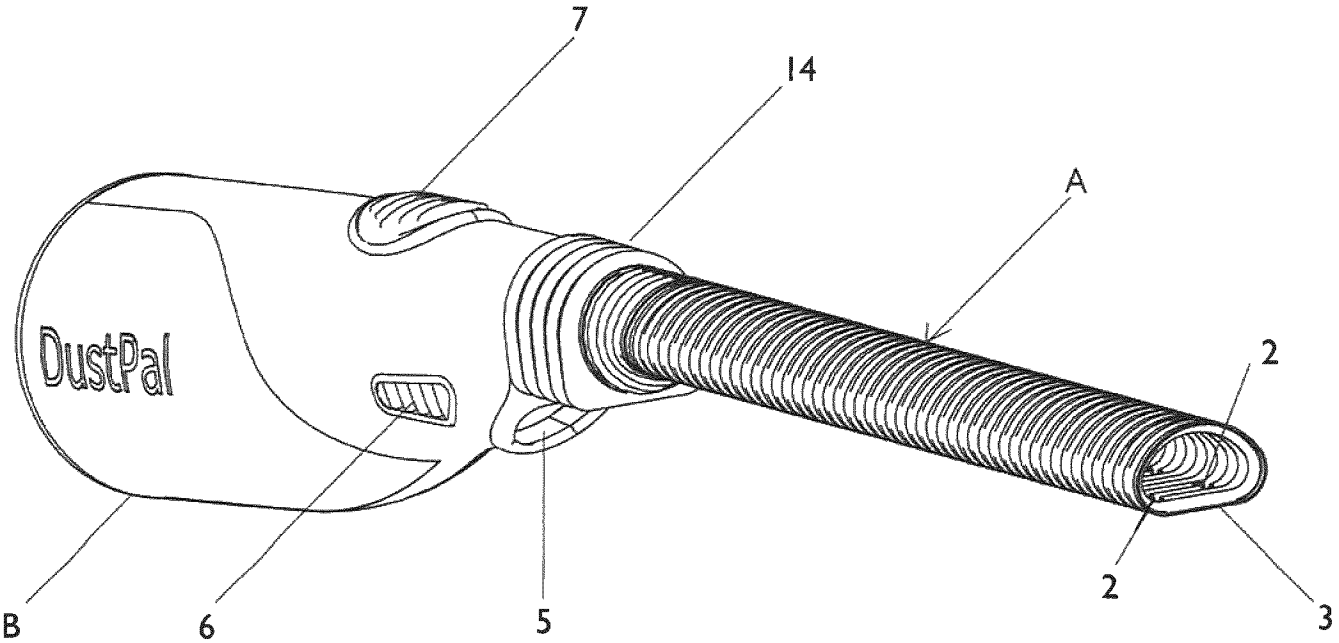
FIG. 8. shows yet another embodiment of the present invention, where the elongate hollow body has an oval cross section.

FIG. 7, shows yet another embodiment of the present invention, where a plurality of perforations 2 is arranged on the outer surface shell surface and over the entire length of the elongate hollow body A. Each perforation 2 has a circular shape, and wherein each perforation 2 extends from the hollow section of the hollow body A and through the outer shell and connects with one of the grooves 1, for distributing a vacuum in the canal when a dust brushing means (D) is fitted over and covering the groove 1, and the hollow body A is connected to a vacuum source (not shown). According to the invention, the perforation 2 can have different shape and situated at different positions. The FIG. 7 shows the one perforation in connection with one canal, the perforations situated on the underside of the elongate hollow body A viewed in a user position. FIG. 8, shows yet another embodiment of the present invention where the elongate hollow body A comprises a plurality of perforations 2 arranged on the underside of the body A viewed in a user position. The elongate hollow body A has a substantially oval shape with a flatter bottom section, giving a stiffer and more stable elongate body A. The FIG. 8 also shows the embodiment with one perforation 2 in connection with one canal.

Although preferred embodiments of the invention have been illustrated in the accompanying drawings and in the foregoing detailed description, it will be understood that the invention is not limited to the embodiments disclosed, but is capable of numerous arrangements, modifications, and substitutions of parts and element.

The invention claimed is:

1. A dust collecting system comprising;

a dust brushing means;

a hollow body including an outer shell, and an open end, and defining a hollow section, said open end being open to said hollow section of said hollow body; and an adapter-head, said adapter-head comprises a first and a second end, said first end being configured to releasably connect to an intake of an external vacuum source, said second end being configured to releasably connect to said open end of said hollow body by fastening means;

wherein said hollow body includes a plurality of grooves arranged on an outer circumference of said hollow body creating a plurality of canals, and wherein at least one perforation extends from said hollow section of said hollow body and through said outer shell and connects with at least one of said plurality of grooves for distributing a vacuum in at least one of said plurality of canals when said dust brushing means is covering said at least one of said plurality of grooves.

2. The device according to claim 1, wherein each of said plurality of grooves has an annular shape, and said plurality of grooves are arranged in parallel to each other and over at least a part of a length of said hollow body.

3. The device according to claim 1, wherein said least one perforation extends from said hollow section of said hollow body and through said outer shell and connects with at least one of said plurality of grooves.

4. The device according to claim 1, wherein said outer shell includes an inside shell-surface and an outside shell-surface including said outer circumference, and wherein a second plurality of grooves are arranged on said inside shell-surface corresponding to said plurality of grooves on said outside shell-surface, creating a plurality of inside shell-surface canals.

5. The device according to claim 1, wherein said dust brushing means is a stocking-like cover made from air-open fabrics.

6. The device according to claim 5, wherein said stocking-like cover further comprises a plurality of at least one of following materials for attracting and collecting dust, the materials being selected from the group consisting of fluffy fibers, threads, and ribbons.

7. The device according to claim 1, wherein said fastening means is at least one selected from the group consisting of screw fastening, buckle snaps, snap-locks, overlapping sections, pin-lock, friction lock, and fastening and releasing device.

8. The device according to claim 1, wherein said hollow body is made from a flexible material and has at least one of the following shapes selected from the group consisting of elongate, circular, T-shape, S-shape, Y-shape, square, oval, and conical.

9. The device according to claim 1, wherein said hollow body has at least one free end open to said hollow section of said hollow body.

10. The device according to claim 1, wherein said hollow body has an elongated shape.

11. The device according to claim 1, wherein said hollow body has a circular or oval cross-section.

12. The device according to claim 1, wherein said second end includes a flexible joint.

13. The device according to claim 1, wherein said adapter-head includes an eject button for quick releasing of said hollow body.

14. The device according to claim 1, wherein said adapter-head includes a converter arranged at said first end, said converter is configured to allow external vacuum source intakes of various sizes to establish a tight fit with said adapter-head.

15. The device according to claim 1, wherein said adapter-head includes a main suction hole positioned adjacent to said second end of said adapter-head, said main suction hole being open to an exterior of said adapter-head when said hollow body is connected to said adapter-head.

16. The device according to claim 15, wherein said adapter-head includes at least one valve configured to control the vacuum in said hollow body and said main suction hole.

17. The device according to claim 16, wherein said valve is at least two valves located in opposite sections of said adapter-head, each of said valves being controllable by a finger of a user.

18. The device according to claim 16, wherein said valve includes a plurality of flaps arranged at a valve opening.

19. The device according to claim 1, wherein said open end of said hollow body includes an extended key lock section that is receivable through said second end of said adapter-head, said extended key lock section being configured to lock said hollow body to said adapter-head.

20. The device according to claim 9, wherein said hollow body is oval in shape with a flattened bottom section featuring said perforations, and wherein said perforations being alternating offset from each other along a longitudinal length of said flattened bottom and varying in size from said open end to said free end.

* * * * *